US006032383A

United States Patent [19]

Fleissner

[11] Patent Number: 6,032,383

[45] Date of Patent: Mar. 7, 2000

[54] DEVICE FOR THROUGH-FLOW CONTINUOUS HEAT TREATMENT OF TEXTILES, FABRIC, OR THE LIKE

[75] Inventor: Gerold Fleissner, Zug, Switzerland

[73] Assignee: Fleissner GmbH & Co., Egelsbach, Germany

[21] Appl. No.: 09/038,007

[22] Filed: Mar. 11, 1998

[51] Int. Cl.[7] ..... F26B 11/02

[52] U.S. Cl. ..... 34/115; 34/125

[58] Field of Search ..... 34/560, 110, 114, 34/115, 120, 122, 125; 26/74, 75, 76; 68/5 D, 158, 903

[56] References Cited

U.S. PATENT DOCUMENTS

| | | | |
|---|---|---|---|
| 4,506,459 | 3/1985 | Swick | 34/110 |
| 4,912,945 | 4/1990 | Fleissner | 68/5 D |
| 5,052,197 | 10/1991 | Fleissner | 68/5 D |
| 5,570,594 | 11/1996 | Fleissner | 68/5 D |
| 5,711,087 | 1/1998 | Pazdera | 34/114 |

*Primary Examiner*—Henry Bennett
*Assistant Examiner*—Steve Gravini
*Attorney, Agent, or Firm*—Antonelli, Terry, Stout & Kraus, LLP

[57] ABSTRACT

A screen drum design is known whose drum jacket consists of axially extending sheet metal strips whose widths extend in the radial direction. These sheet metal strips must be permanently attached to the end bottoms to produce the drum jacket. According to the invention, this connection is made movable. For this purpose, a connecting element (17) is provided that consists of one or two connecting arms (18, 19) connected with one another so that they are pivotable with respect to one another, said arms being connected, with articulation at their free ends, with either sheet metal strips (13) or a centering ring (29) for the sheet metal strips, or with bottoms (11, 12) that are located at a distance from the ends of sheet metal strips (13) and/or centering ring (29). In this way, movement of the drum jacket relative to bottoms (11, 12) is always possible to compensate for dimensional changes resulting from temperature fluctuations.

16 Claims, 3 Drawing Sheets

DEVICE FOR THROUGH-FLOW CONTINUOUS HEAT TREATMENT OF TEXTILES, FABRIC, OR THE LIKE

BACKGROUND OF THE INVENTION

The invention relates to a device for through-flowing continuous heat treatment of textile material, fleece, or paper in web form, with a permeable drum that is subjected to suction and has bottoms on the ends as a transport element, said drum being covered on its circumference by a covering that is perforated or in the form of a sieve, with sheet metal strips permanently attached to the bottoms extending from one bottom to another between the bottoms of the drum, with the lateral extent of said strips being in the radial direction.

A device of this type is known from DE 38 21 330 A1. It has the advantage that it is optimally permeable to air without the stability of the drum being reduced thereby. Another advantage is the bolted design implemented in this device. Without having to resort to the previously known welded construction, all drum jacket elements are thus permanently attached to one another by the bolted rib connections through the connecting ribs that run in the circumferential direction over the drum with the sheet metal strips that extend lengthwise across the drum. The changes in structure in the metal, which are so disadvantageous when the welded seams that are otherwise necessary are produced, are avoided in this bolted construction.

Regardless of whether the drum jacket design is welded or created by the bolted connections, the connection of the sheet metal strips to the bottoms of the drum, in other words firstly to one bottom and secondly with the nozzle star through which the fan subjects the interior of the drum to suction, is exposed during use to the higher thermal stresses encountered in practice. The bottoms have a greater heat capacity than the sheet metal strips. When a cold material enters the heated drum housing, the sheet metal strips cool off suddenly on contact with the material but initially the bottoms do not, so that there are considerable stresses in the material that lead to cracks or dents in the drum. This occurs independently of the drum design, i.e. regardless of whether it is welded or bolted.

SUMMARY OF THE INVENTION

The goal of the invention is to provide a connection between sheet metal strips or their associated fastening elements and the respectively adjacent bottoms of the drum, allowing constant equalization of the changes in the dimensions of the material that take place because of the temperature changes in this area, so that there is no increase in material stresses on the drum bottoms, especially in the vicinity of the connecting points of the sheet metal strips.

Taking its departure from the basic drum design with the sheet metal strips of the type recited at the outset, the invention provides, for achieving the set goal, that the sheet metal strips are attached to the bottoms using a separate connecting element that is permanently connected with both the sheet metal strips and the associated bottoms, and is nevertheless designed to be articulated.

Here again it is advantageous to create the connecting element itself and/or the connection with the bottoms or the sheet metal strips by means of permanently tightened bolts. It is important however that the connecting element be movable even during operation and that it be able elastically to permit the movements of the drum jacket relative to the drum bottoms, permanently and without material fatigue of any parts involved.

To achieve the stated goal it is possible to connect the sheet metal strips themselves, or the sheet metal strips initially permanently with a separate centering ring, and then to connect the latter radially movably with the drum bottoms. The connection advantageously can consist of a four-link articulation ring which permits radial compensating movements unchanged centrally.

BRIEF DESCRIPTION OF THE DRAWINGS

Special embodiments of the connecting element are the subject of the invention. They are disclosed in other claims and in the drawings provided as examples with the description of the figures.

BRIEF DESCRIPTION OF THE PREFERRED EMBODIMENTS

Figure 1:
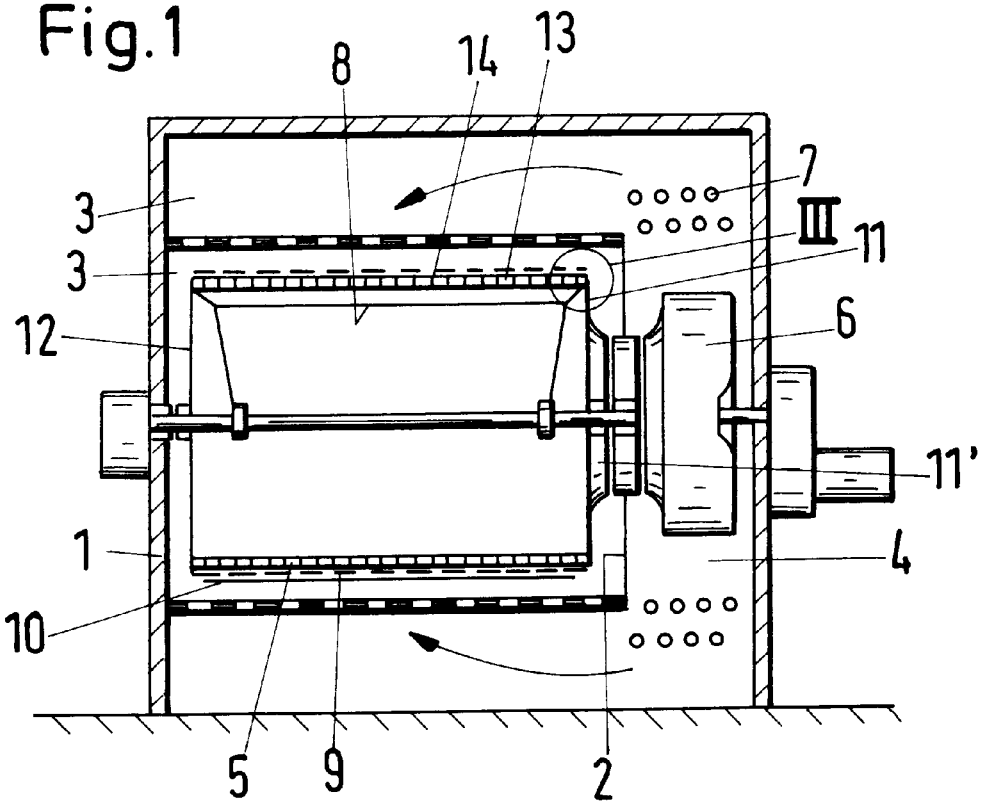
FIG. 1 is a lengthwise section through a conventional screen drum device whose sheet metal jacket in this case consists of a jacket structure composed of sheet metal strips, with screen fabric applied externally.

A screen drum device consists basically of an approximately rectangular housing 1 divided by a partition 2 into a processing chamber 3 and a fan chamber 4. Screen drum 5 and concentrically thereto a fan 5 in fan chamber 4 are mounted rotatably in processing chamber 3. Of course the fan chamber can also be located in a fan housing that is separate and not connected with screen drum housing 1, not shown here. In any case the fan subjects the interior of drum 5 to suction. In addition, the drum design, that can also serve only for drawing off liquid, is the subject of the patent. The overall design is then adapted accordingly.

According to FIG. 1, there are heating assemblies 7 above and below fan 6 which consist of tubes through which a heating medium flows. The screen drum, in the area not covered by textile material 10, is sealed off internally against the suction by an internal covering, not shown. The jacket structure of the screen drum that supports textile material 10 is formed by the sheet metal strip structure described below. This is held externally under tension by a fine mesh screen 9 that is stretched over the ends of the drum at bottoms 12 and bottom 11 with nozzle star 11'.

Figure 2:
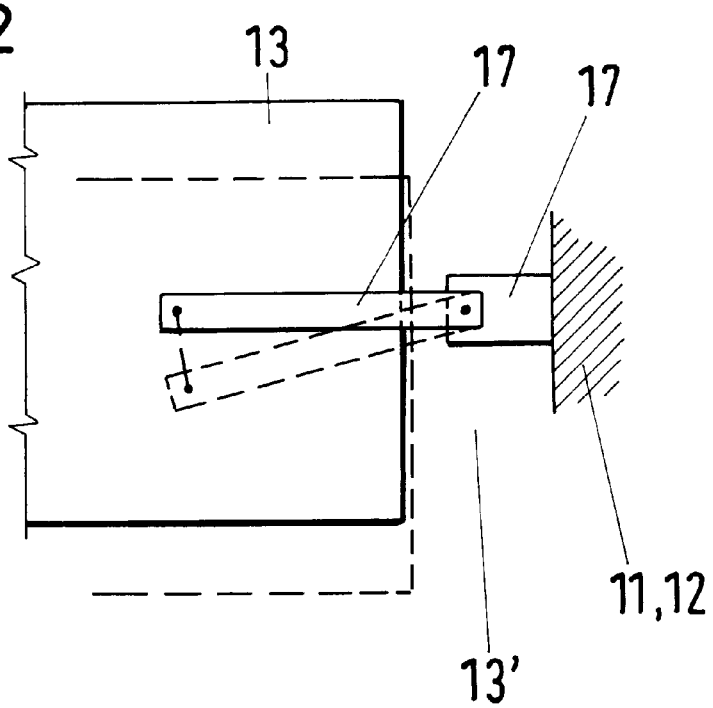
FIG. 2 shows the principle of the movability of the sheet metal strips relative to the endwise bottoms.
Figure 3:
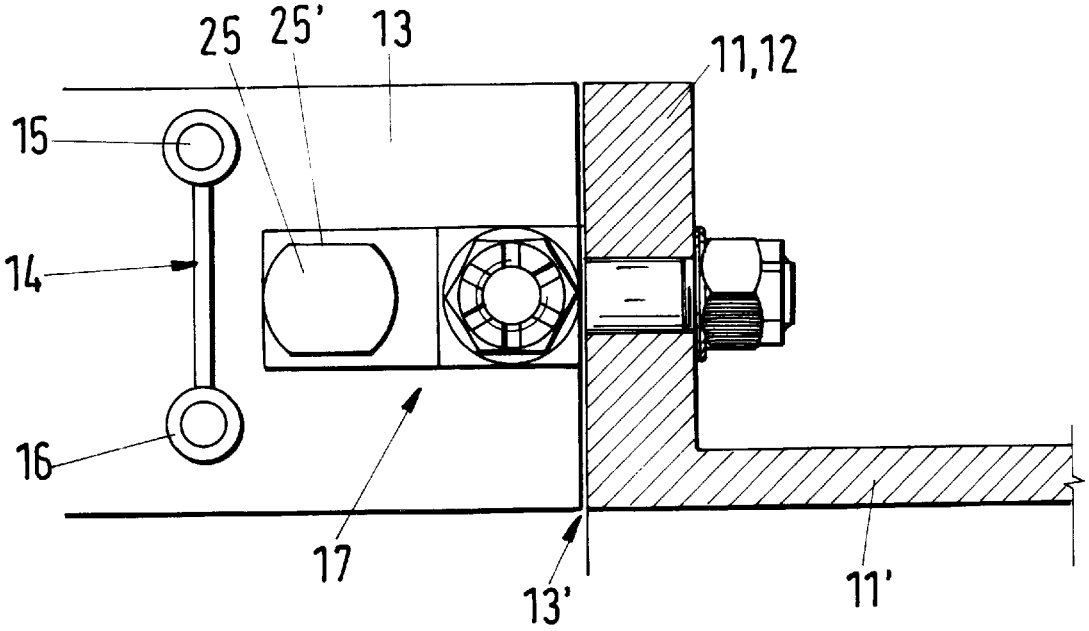
FIG. 3 shows detail III in FIG. 1 in an enlarged view.
Figure 4:
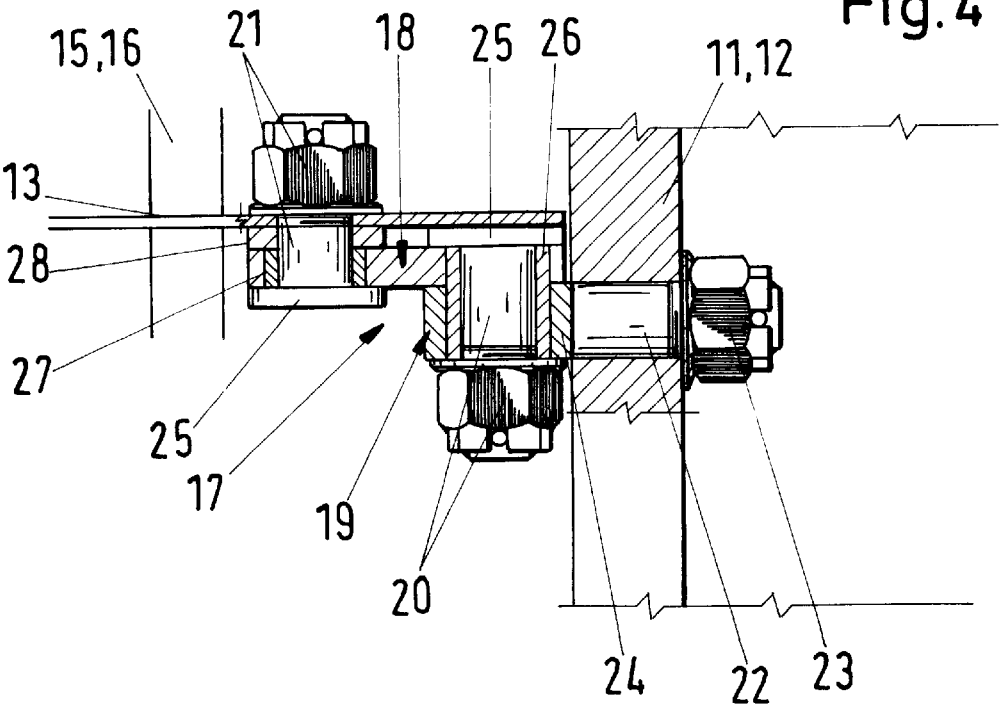
FIG. 4 is a section through the detail, perpendicular to the view in FIG. 3.

The sheet metal strip structure consists of axially aligned sheet metal strips 13 whose radial aligned height follows from FIGS. 2 to 4. Hence, the screen covering 9 lies only on the radially outwardly located edges of sheet metal strips 13. Sheet metal strips 13 are fastened with a specific distance between them, side by side at the two bottoms 11, 12 by the connecting element 17 shown in FIGS. 3 and 4. In order for this distance to be constant over the circumference of the drum, connecting ribs are provided as spacers and designated as a whole by 14, said ribs being connected with sheet metal strips 13 by bolts 15 and 16 that extend over the circumference.

Sheet metal strips 13 must be connected with bottoms 11, 12 since they support textile material 10 that is pressed by suction firmly against the drum jacket formed by parts 13, 14. On the other hand, as a result of temperature changes especially in the vicinity of the connection of the drum jacket with the drum bottoms, material stresses develop during operation that can result in the destruction of a rigid connection. It is therefore advantageous for a movable connection to be provided at such points. This is shown in principle in FIG. 2. Sheet metal strips 13 are supposed to be fastened movably to bottoms 11, 12. This is accomplished with a connecting element 17 that is fastened with articulation firstly to bottoms 11, 12 and secondly to sheet metal strips 13. Since an air gap 13' is also left between the ends of sheet metal strips 13 and the associated walls of bottom 11, 12, displacement of sheet metal strips 13 upward or, as indicated by the dashed lines, downward, can be performed without difficulty even during operation.

This principle is implemented in the device shown in FIGS. 3 and 4. Connecting element 17 consists of two connecting arms 18, 19 movably connected with one another by a bolt 20, with the free ends of said arms being connected movably with sheet metal strips 13 by a bolt 21 and with the respective bottoms 11, 12 by means of a mandrel 22 that extends through bottoms 11, 12 and accepts a firmly tightened nut.

In the vicinity of bottoms 11, 12, connecting arm 19 consists of a block 24 that has a central bore through which bolt 20 can be inserted. This block 24 has an axially parallel contact surface that abuts the adjacent internal surfaces of bottoms 11, 12. From the contact surface, mandrel 22 extends from block 24 through bores in bottoms 11, 12 and has a thread provided at the end on which nut 23 can be tightened. This makes this connection rigid.

The body of bolt 20 or bolt 21 has a flat piece 25 at the end opposite the nut that is the head of the bolt. This head is not intended to provide vertical support but only to form a permanent bolted connection. To tighten the nut during assembly, a bevel 25' for application of an open-end wrench is provided on flat piece 25.

The other connecting arm 15 is rotatably attached to block 24 and/or connecting arm 19. It consists of a lever aligned parallel to sheet metal strip 13, at each of whose ends bores are provided for bolts 20, 21. The shaft of bolt 20 is initially surrounded by a spacing cylinder 26 which extends both over the height of connecting arm 16 and also over the height of the immediately abutting block 24 and is fitted into these bores. Spacing cylinder 26 is longer by a small amount (approximately 0.1 mm) than the height of block 24 plus the height of connecting arm 18, so that after bolt 20 is tightened, connecting arm 18 will pivot easily around block 24. A precondition for this is an air gap 13' of approximately 2–3 mm between the end of sheet metal strip 13 and the associated surface of bottom 11, 12.

The same applies to the rotary connection with bolt 21. In this case spacing cylinder 27 is longer by a small amount (approximately 0.1 mm) than the height of connecting arm 18 alone. Between connecting arm 18 and sheet metal strip 13, however, a spacing ring 28 is pushed onto the threaded bolt that is thicker heightwise by a certain amount (approximately 1 mm) than the flat piece 26 of the head of bolt 20 in order to prevent the head from rubbing on sheet metal strip 13.

Figure 5:
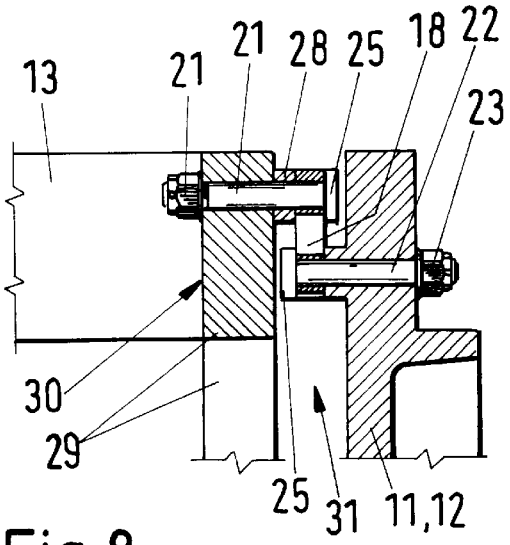
FIG. 5 shows detail III in FIG. 1 in another design than in FIG. 3.

In FIG. 5, in contrast to the solution shown in FIGS. 3 and 4, a design with different details is shown. In this case the individual sheet metal strips 13, as is known, are connected with an additional centering ring 29. This permanent connection 30 is intended to be produced by a bolted structure known of itself but not shown here. As a result, the drum consisting of two centering rings 29, with the plurality of sheet metal strips 13 mounted on the outer circumference between them to form the drum jacket, is a stable, solid structure. In this case, only a change in dimension caused by temperature or by centrifugal force is possible, but it does not cause any damage because the centering rings can expand with it and they do not weigh a great deal.

Figure 6:
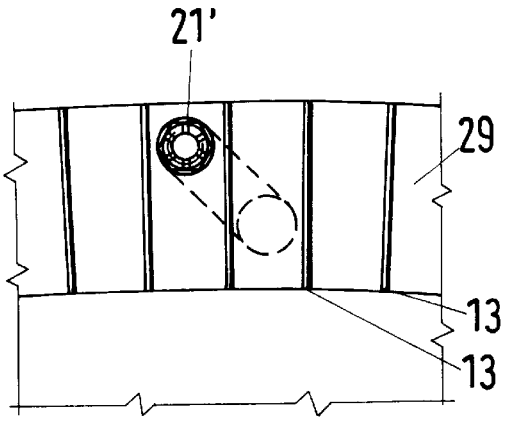
FIG. 6 is a section made transversely through the drum in the vicinity of detail III according to FIG. 5, with the centering ring in an end view.
Figure 8:
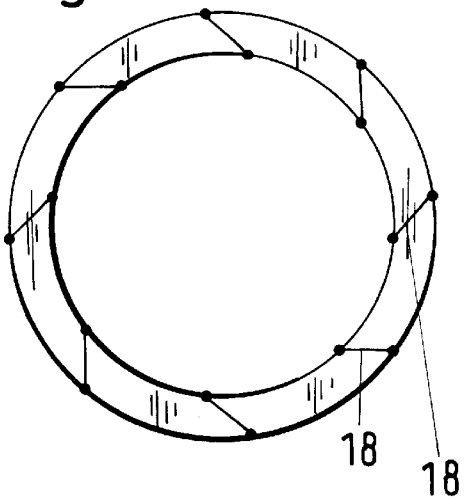
FIG. 8 likewise shows a section through the drum as in FIG. 5 but the entire drum on a reduced scale.
Figure 7:
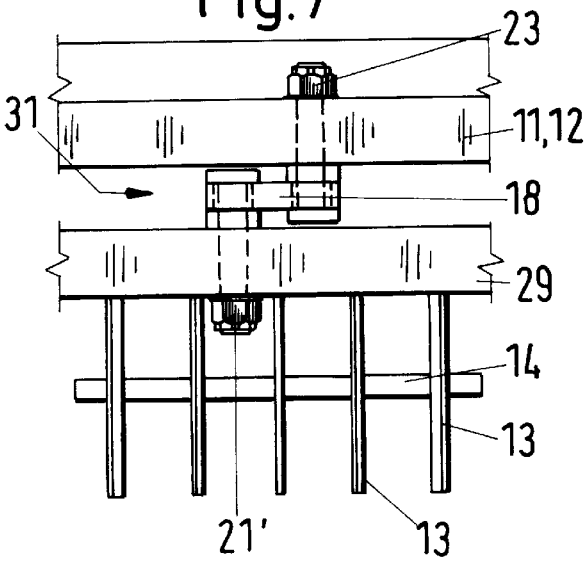
FIG. 7 is a radial top view of the connecting design according to FIG. 5.

The movable connection is then created between centering ring 29 and the associated bottoms 11, 12. A gap 31 is provided in which sufficient space is available to locate a jointed ring 32 shown theoretically in FIG. 8. Articulated ring 32 consists of a plurality of connecting arms 18 designed as connecting elements and also shown in FIGS. 6 and 7, said arms not being aligned radially but along a secant, in other words opposite the radials at an angle of less than 180°. Here the connecting arms 18 are each provided on two diameters, articulated and held in place, with the radially inner one being provided on bottoms 11, 12 in the embodiment and the radially outer one being provided on centering ring 29. Thus, with a change in diameter of the drum, movable compensation with respect to drum bottom 11, 12 can take place for example as a change in diameter of the drum, with connecting arms 18 aligning themselves so that the angle of connecting arms 18 to the radials increases.

In order to make this possible, connecting arms 18 each have at their ends a bore through which a bolt 22, 23, or 21 is inserted and bolted to either centering ring 29 or to the associated bottoms 11, 12. Between connecting ring 18 and centering ring 29 on the one hand and between connecting arm 18 and bottoms 11, 12 on the other, a spacing ring 28 is also pushed onto threaded bolt 21, 22 which in turn is somewhat thicker heightwise than flat piece 25 of the head of bolt 21, 23 in order to prevent head 25 from rubbing on bottoms 11, 12 or on the centering ring.

I claim:

1. Device for through-flow continuous heat treatment of textile material, fleece, or paper in web form, with a processing medium that is circulated in gas form in the device, comprising a drum that is permeable and is subjected to a vacuum and has bottoms provided endwise as a transport element, said drum being covered at its circumference by a covering that is perforated or in the form of a sieve, sheet metal strips permanently attached to the bottoms extending between the bottoms of the drum from one bottom to another bottom, with their widths extending in the radial direction, and a separate connecting element provided for fastening the sheet metal strips to the bottoms, said connecting element being permanently attached both to the sheet metal strips and to the associated bottoms and nevertheless being articulated.

2. Device according to claim 1, further comprising a bolted connection for fastening the connecting elements to both the sheet metal strips and the bottoms.

3. Device according to claim 1 or 2, wherein the connecting element is movable and elastic even during operation.

4. Device according claim 1, wherein an air gap is provided between the end of sheet metal strip and the associated bottom that permits movement of the sheet metal strip relative to the bottom.

5. Device according to claim 1, wherein the connecting element comprises two connecting arms connected with one another by a bolt, said arms being connected at their free ends with either the sheet metal strips or the bottoms by a bolt.

6. Device according to claim 5, wherein the connecting arm connected with the bottom consists of a block or ring, or the like provided with a bore, with an axially parallel contact surface on the bottom and a mandrel that projects from the contact surface of the block and is provided with a thread at one end, the axis of said mandrel extending perpendicularly to the axis of the bore and being capable of being inserted through the bottom and permanently tightened on the other side of the bottom by a nut against the bottom.

7. Device according to claim 6, wherein the connecting arm connected with the sheet metal strip consists of a lever aligned parallel to the sheet metal strip, with a bore being provided at the end of said lever for fastening either to the sheet metal strips or to the block by bolt.

8. Device according to claim 7, wherein the bolt is a threaded bolt with a thread for the nut at its end and whose head consists of a flat piece that lengthens the bolt only slightly, with a bevel for application of an open-end wrench that serves for assembly.

9. Device according to claim 8, wherein between the connecting arm and the sheet metal strip, a spacing ring is pushed onto the threaded bolt that is inserted through the connecting arm, with the height of said ring being greater than the height of the flat piece of the bolt provided for fastening the connecting arm to the block.

10. Device according to claim 7, further comprising spacing cylinders initially fitted into the bores of the connecting arm that receives the bolt, with the height of said cylinders being greater than the height of the connecting arm in the case of fastening a sheet metal strip, or a spacing cylinder is inserted whose height is greater than the height of the connecting arm including the height of the block in the case of the fastening block.

11. Device according to claim 1, wherein the sheet metal strips are fastened permanently by a screw connection to a centering ring, and the articulated connecting element is provided in a gap between the centering ring and the associated bottoms.

12. Device according to claim 11, wherein the centering ring and the bottoms are connected with one another movably and elastically by the connecting element.

13. Device according to claim 12, wherein the connecting element consists of a connecting arm held movably at its ends either on the centering ring or on the associated bottom.

14. Device according to claim 13, wherein the connecting arm has at each of its ends a bore through which a bolt is inserted and bolted to either the centering ring or to the associated bottom.

15. Device according to claim 13, wherein the connecting arm is not aligned radially between the centering ring and the bottom but is provided at an angle to the radial that is more than 90° but less than 180°.

16. Device according to claim 15, wherein a plurality of such connecting arms is arranged around the circumference of the drum in a circular ring with equal radial spacing from the axis of the drum.

* * * * *